United States Patent [19]

Latraverse

[11] Patent Number: 4,494,323

[45] Date of Patent: Jan. 22, 1985

[54] DETACHABLE SHOE HEEL

[76] Inventor: Wendy R. Latraverse, 14B Mayberry Dr., Westboro, Mass. 01581

[21] Appl. No.: 374,074

[22] Filed: May 3, 1982

[51] Int. Cl.[3] ..... A43B 21/36; A43B 21/51

[52] U.S. Cl. ..... 36/42; 36/24.5; 36/36 R

[58] Field of Search ..... 36/42, 41, 36 R, 24.5, 36/15

[56] References Cited

U.S. PATENT DOCUMENTS

| | | | |
|---|---|---|---|
| 1,772,069 | 8/1930 | Collier et al. | 36/42 |
| 2,795,867 | 6/1957 | Zuckerman et al. | 36/42 |
| 2,933,830 | 4/1960 | Bartels et al. | 36/15 X |

FOREIGN PATENT DOCUMENTS

| | | | |
|---|---|---|---|
| 498410 | 10/1919 | France | 36/42 |
| 1230556 | 4/1960 | France | 36/42 |
| 711901 | 7/1966 | Italy | 36/42 |
| 25849 | of 1906 | United Kingdom | 36/15 |
| 20598 | of 1913 | United Kingdom | 36/42 |

*Primary Examiner*—James Kee Chi

*Attorney, Agent, or Firm*—Blodgett & Blodgett

[57] ABSTRACT

Shoe comprising an upper portion, a sole attached to the upper portion, a detachable heel engagable with the lower surface of the sole and having a keyway extending downwardly from the upper surface of the heel, and a retainer key mounted in the sole and adapted to extend into the keyway when the heel is applied to the sole for releasably locking the heel to the sole.

6 Claims, 8 Drawing Figures

DETACHABLE SHOE HEEL

BACKGROUND OF THE INVENTION

The invention is generally directed to a shoe with a detachable heel and is specifically directed to a shoe having a novel attaching mechanism for the heel.

Shoes with detachable heels are generally known and the means for detachably holding the heel to the shoe takes a variety of forms. The advantage of a shoe with a detachable heel is that it provides versatility to the shoe. Since the shoe can be made with a plurality of heels, one set of shoes can function to serve a variety of purposes and can be used for different activities. Also, the detachable heel makes it easier to replace or repair a damaged or worn heel.

Although there are many advantages to having a shoe with a detachable heel, the prior art shoes have a number of problems. In most cases, the means for detaching the heel to the shoe are complicated and add greatly to the expense of the shoe. In some cases the attaching means are visible after the heel is attached so as to detract from the aesthetic appearance of the shoe. Very often, the heel becomes loose from the shoe within a very short period of time after application to the shoe. Some detachable heels require the use of special tools which makes it inconvenient to change or replace the heel or to tighten the heel when it becomes loose. This problem is particularly acute if the user is in a place where the tools are not available. These and other difficulties experienced with the prior art devices have been obviated by the present invention.

It is, therefore, an outstanding object of the invention to provide a shoe having a detachable heel which is held securely on the shoe and yet is easily detached and replaced.

Another object of this invention is the provision of a shoe which the heel attaching elements are hidden from view, once the heel has been attached.

A further object of the present invention is the provision of a shoe having a detachable heel in which the attaching elements are simple in construction, which are inexpensive to manufacture, and which are capable of a long life of useful service with a minimum of maintenance.

With these and other objects in view, as will be apparent to those skilled in the art, the invention resides in the combination of parts set forth in the specification and covered by the claims appended hereto.

SUMMARY OF THE INVENTION

In general, the invention consists of a shoe having an upper portion, a sole attached to the upper portion, a detachable heel and means for detachably fastening the heel to the sole. The upper surface of the heel fits snugly against the lower surface of the heel portion of the sole and the heel has a keyway which extends downwardly from its upper surface. A retainer key is mounted in the sole and extends freely into the keyway when the heel is applied to the sole. The key is rotatably mounted in the sole so that rotation of the key after it is inserted into the keyway causes the heel to be locked to the sole.

More specifically, the heel portion of the sole has an annular recess in its upper surface and the key has a head portion which is located in the recess so that it is located below the upper surface. The head portion of the key has a reduced horizontal dimension which enables the head to be grasped by the users fingers within the recess for rotating the key, for the purpose of attaching the heel to the sole or detaching the heel from the sole.

BRIEF DESCRIPTION OF THE DRAWINGS

The character of the invention, however, may be best understood by reference to one of its structural forms, as illustrated by the accompanying drawings, in which.

DESCRIPTION OF THE PREFERRED EMBODIMENT

Figure 1:
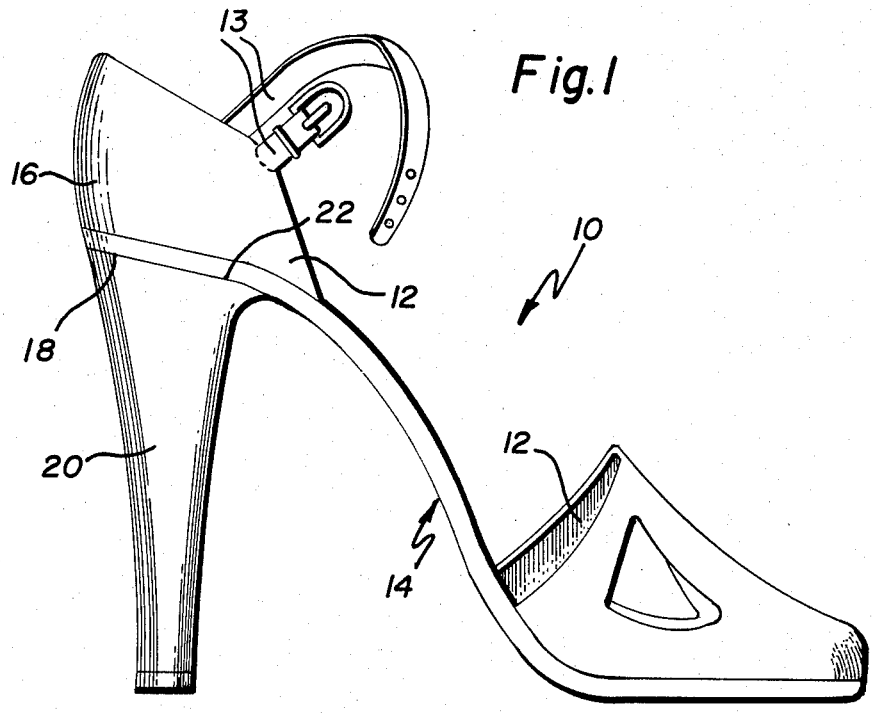
FIG. 1 is a side elevational view of a shoe embodying the principles of the present invention.
Figure 2:
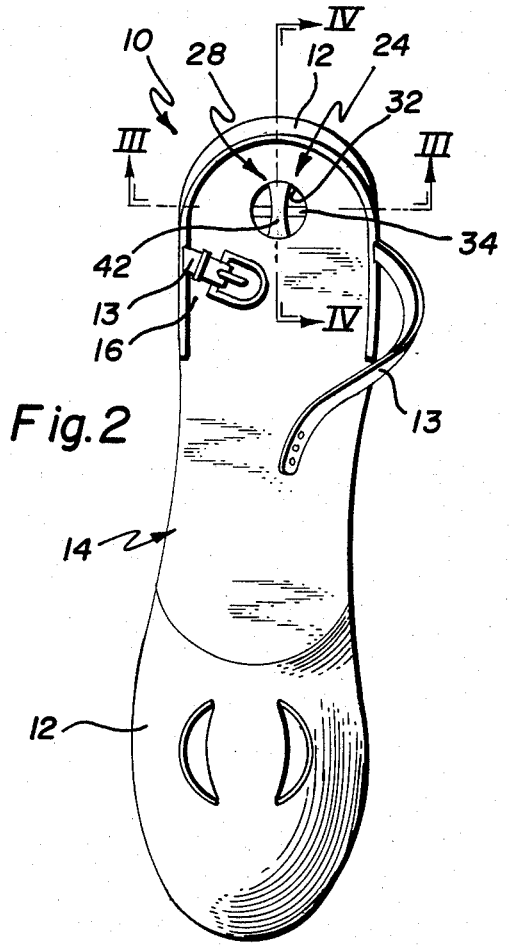
FIG. 2 is a plan view of the shoe.
Figure 3:
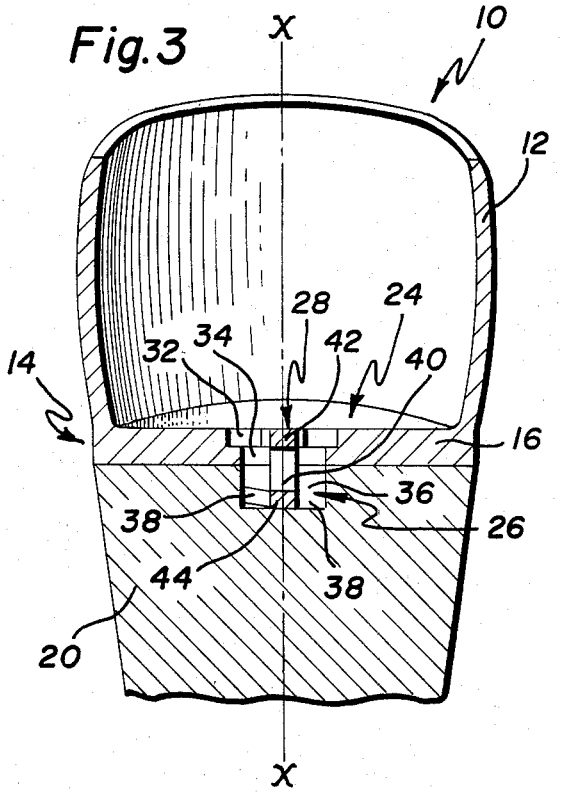
FIG. 3 is a vertical sectional view of the shoe, taken on the line III—III of FIG. 2 and looking in the direction of the arrow.

Referring first to FIGS. 1 and 2, which best show the general features of the invention, the shoe, indicated generally by the reference numeral 10 is shown as a women's high-heeled shoe for purposes of illustration only. It is to be understood that the invention is applicable to any type of shoe. The shoe as illustrated in FIGS. 1 and 2 includes an upper portion 12 including straps 13, a sole generally indicated by the reference numeral 14, and a detachable heel 20. The sole 14 includes a heel portion 16 which has a lower surface 18. The detachable heel 20 has an upper surface 22 which fits snugly against the lower surface 18 when the heel is attached to the sole.

Figure 4:
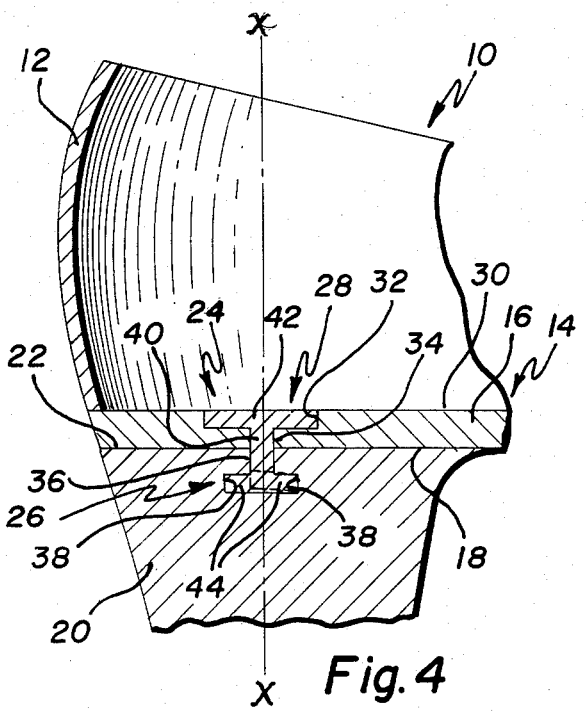
FIG. 4 is a vertical sectional view of the shoe, taken on line IV—IV of FIG. 2 and looking in the direction of the arrows.
Figure 5:
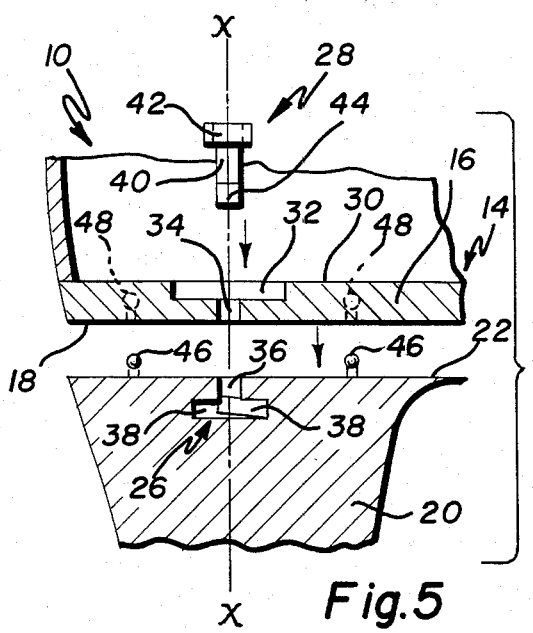
FIG. 5 is a sectional view similar to FIG. 4, showing the elements of the shoe in exploded position.
Figure 6:
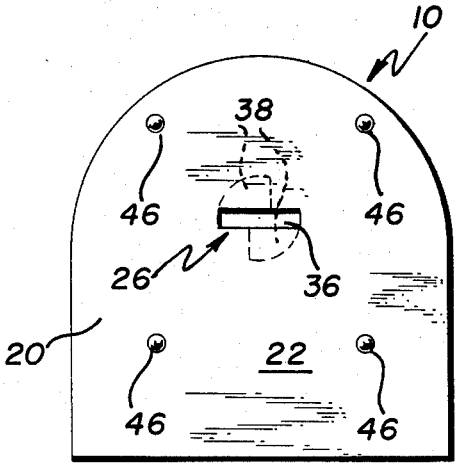
FIG. 6 is a top plan view of the heel.

The heel 20 is detachably fastened to the heel portion 16 of the sole by fastening means generally indicated by the reference numeral 24, see also FIGS. 3–7. The fastening means 24 includes a keyway generally indicated by the reference numeral 26 and a retainer key generally indicated by the reference numeral 28. The heel portion 16 of the sole has an upper surface 30 which is provided with an annular recess 32. An elongated vertical slot 34 extends downwardly from the annular recess 32 and through the lower surface 18. The keyway 26 includes a vertical groove 36 which extends downwardly from the upper surface 22 and a pair of diametrically opposed horizontal grooves 38 which extend laterally from the groove 36. Each of the horizontal grooves 38 extends along an arc which is generated about a vertical axis Y—Y. Each groove 38 has a downward lead away from the vertical groove as shown in FIGS. 4 and 6.

The retainer key 28 includes a shank portion 40, a head portion 42 at one end of the shank portion and a pair of diametrically opposed projecting portions 44 at the opposite end of the shank portion. As shown in FIG. 4, the projecting portions 44 extends laterally from the shank portion. The retainer key 28 is adapted to be inserted freely through the slot 34 of the sole and groove 36 of the heel when the heel is properly positioned on the sole as shown in FIG. 4. When the key 26 is inserted in the keyway 28, the head 42 lies within the recess 32 and below the upper surface 30. Head 42 is elongated as shown in FIG. 2 so that when it is located in the recess 32, there is a space on each long side of the head 42 so that the head may be grasped by the fingers and rotated about the vertical axis X—X. This enables the key to be turned to the locking and unlocking position, respectively, for attaching and detaching the heel from the sole. The key 26 is shown in the locking or fastening position in FIGS. 2–4. In this locking position, the projecting portions 44 of the key extend into the horizontal grooves 38, see particularly FIG. 4.

Figure 7:
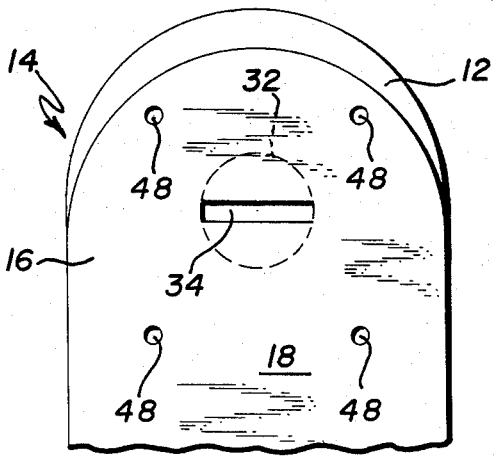
FIG. 7 is a bottom plan view of the heel portion of the sole.

Referring particularly to FIGS. 5–7, the heel 20 has a plurality of locating pins 44 which extend upwardly from the upper surface 22. The heel portion 16 of the sole 14 is provided with a plurality of holes 48 in the upper surface 18. When the heel 20 is properly positioned beneath the sole portion 16, the projecting pins 26 are aligned with the respective holes 48. When the heel 20 is then pressed against the sole, the projecting portions 46 enter the holes 48. The locating pins 46 ensure that the slot 34 of the sole will be vertically aligned with the vertical groove 36 of the heel and also prevents the heel from being rotated relative to the sole about the vertical axis X—X. The ends of the locating pins 46 are slightly enlarged and the interior of each hole 48 is slightly enlarged so that the locating pins 46 fit into the corresponding holes 48 with a snap fit.

The operation and advantages of the present invention will now be readily understood in view of the above description. Referring particularly to FIG. 5, the shoe 10 is assembled by vertically aligning the heel 20 with the heel portion 16 of the sole so that the upper surface 22 of the heel is just below the lower surface 18 of the sole. In this position, the slot 34 in the sole is vertically aligned with the groove 36 in the heel along the axis X—X and the locating pins 46 are vertically aligned with corresponding holes 48 in the sole. The heel 20 is moved vertically along the axis X—X so that the locating pins 46 are forced into the holes 48 and the upper surface 22 of the heel abutts the lower surface 18 of the sole. The locating pins 46 ensure that the slot 34 is exactly aligned with the vertical groove 36. The retainer key 28 is then positioned along the axis X—X so that the projecting portions 44 are aligned with the slot 34. The key 28 is then inserted through the slot 34 into the groove 36 of the keyway 26. The head 42 is grasped with the fingers and rotated 90° in a clockwise direction as viewed in FIG. 2 about the vertical axis X—X. This causes the projecting portions 44 of the key to enter the horizontal grooves 38 as shown in FIG. 4. Since each groove 38 has a downward lead, the movement of the projecting portions 44 in the grooves 38 enables the key 28 to draw the heel 20 tightly against the heel portion 16 of the sole. The fastening means 24 ensures that the heel is tightly and securely mounted on the sole of the shoe. The retaining pins 46 further ensure against rotation of the heel about the vertical axis X—X to prevent any working loose of the fastening means 24. It can be seen that the fastening means 24 enables the heel 20 to be applied to the sole 14 very quickly and efficiently and without the need of special tools.

The heel 20 is removed from the sole 14 just as easily as it is applied. Removal of the heel is simply a matter of reversing the process of applying the heel. The head 28 of the retainer key is grasped by the fingers by the user and rotated 90° in a counterclockwise direction, as viewed in FIG. 2, about the vertical axis X—X. This brings the projecting portions 44 into alignment with the vertical groove 36 and the slot 34. The key is then simply lifted out of the keyway 26. Finally, the heel 20 is pulled away from the sole 14 so that the locating pins 46 pop out of respective holes 48 to the position shown in FIG. 5. It is also clear that once the shoe 10 is assembled, the fastening means 24 is hidden from view except when the shoe is viewed from the top as shown in FIG. 2. However, even this exposure of the fastening means is concealed once the shoe is positioned on the foot of the wearer. Also, the head 42 of the retainer key 28 extends below the upper surface 30 of the sole so that there is no discomfort to the wearer.

Figure 8:
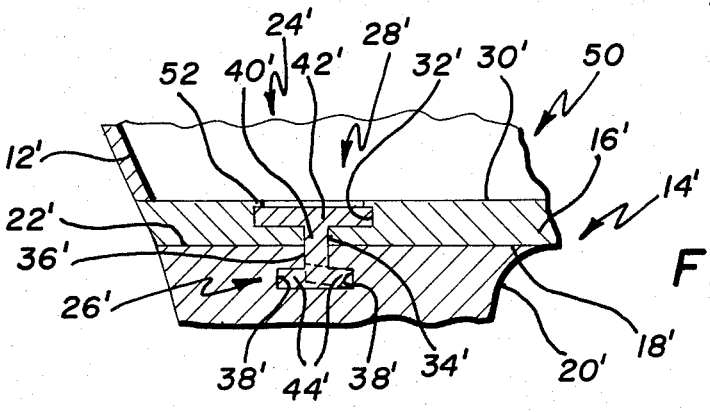
FIG. 8 is a sectional view similar to FIG. A and showing a modification.

Referring to FIG. 8, there is shown a modified shoe, generally indicated by the reference numeral 50. Elements of shoe 50 which are comparable to shoe 10 are identified by the same reference numerals with the addition of a prime. Shoe 50 is identical to the shoe 10 except that upper surfaces 30' of the sole has an annular recess 32' which is provided with an annular lip 52 which extends above head 42' of retainer key 28'. In this embodiment, the retainer key 28' remains permanently attached to heel portions 16' of the sole 14'. Otherwise, retainer key 28' functions in much the same way as retainer key 28. The only difference in the assembly of the elements of the shoe 50 is that when the heel 20' is applied to the sole portion 16' the key 28' must be properly aligned with the slot 34' and the groove 36' as the heel is applied to the sole. Although not shown in FIG. 8, the heel 20' is also provided with retaining pins such as those shown in FIG. 5 and the sole 14' is provided with corresponding holes such as 48 shown in FIGS. 5 and 7.

It is obvious that minor changes may be made in the form and construction of the invention without departing from the material spirit thereof. It is not, however, desired to confine the invention to the exact form herein shown and described, but it is desired to include all such as properly come within the scope claimed.

The invention having been thus described, what is claimed as new and desired to secure by Letters Patent is:

1. Shoe comprising:

(a) an upper portion, (b) a sole attached to the upper portion, said sole having a heel portion which has a lower surface and an upper surface which is provided with a circular recess, (c) a detachable heel having an upper surface for closely engaging said lower surface, said heel having a keyway which extends downwardly from the upper surface, and (d) a retainer key mounted in the sole for rotation about a vertical axis and which is adapted to extend freely into the keyway when said upper and lower surfaces are properly engaged, said retainer key being complementary with said keyway so that rotation of the key about said vertical axis releasably locks the heel to the sole, said key having a head portion which is located in the recess so that it is below said upper surface, said head being elongated in the horizontal plane which enables the head to be grasped by the user's fingers within the recess for rotating the key about said vertical axis.

2. Shoe comprising:

(a) an upper portion, (b) a sole attached to the upper portion, said sole having a heel portion which has a lower surface, (c) a detachable heel having an upper surface for closely engaging said lower surface, said heel having a keyway which extends downwardly from the upper surface, said keyway having a vertical groove and a horizontal groove which extends from the vertical groove along an arc which is generated about a vertical axis, said arc having a helical lead, and (d) a retainer key mounted in the sole for rotation about said vertical axis and which is adapted to extend freely into the keyway when said upper and lower surfaces are properly engaged, said retainer key having a shank portion and a projecting portion which extends laterally from the shank portion, said key being rotatable about said vertical axis between a first position and a second position so that the key is freely insertable into the vertical groove in said first position and the projecting portion is insertable into the horizontal groove upon rotation of the key within said vertical groove from said first position to said second position, and rotation of the key from said first position to said second position causes the heel and sole to be drawn tightly together by the key.

3. Shoe as recited in claim 2, wherein the key has two diametrically opposed projecting portions and the keyway has two diametrically opposed horizontal grooves.

4. Shoe as recited in claim 2, wherein one of said upper and lower surfaces has a vertically extending locating pin and the others of said surfaces has a hole for receiving the pin.

5. Shoe as recited in claim 4, wherein there are a plurality of locating pins and corresponding holes for receiving the pins.

6. Shoe as recited in claim 5, wherein the outer ends of the locating pins are enlarged and the interiors of the holes are enlarged so that the pins fit into the corresponding holes in a tight snap fit.

* * * * *